United States Patent [19]

Kahmann et al.

[11] Patent Number: 5,042,102

[45] Date of Patent: Aug. 27, 1991

[54] DEPLOYABLE BRIDGE

[75] Inventors: Rüdiger Kahmann, Moers; Hans-Norbert Wiedeck, Mülhei, both of Fed. Rep. of Germany

[73] Assignee: Krupp Industrietechnik Gesellschaft mit Beschränkter Haftung, Duisburg, Fed. Rep. of Germany

[21] Appl. No.: 527,333

[22] Filed: Apr. 26, 1990

[30] Foreign Application Priority Data

May 2, 1989 [DE] Fed. Rep. of Germany ..... 3914441

[51] Int. Cl.[5] ..... E01D 15/12

[52] U.S. Cl. ..... 14/2.4; 14/1

[58] Field of Search ..... 14/2.4, 2.6, 1

[56] References Cited

U.S. PATENT DOCUMENTS

| | | | |
|---|---|---|---|
| 4,297,759 | 11/1981 | Soffge et al. | 14/2.6 |
| 4,665,577 | 5/1987 | Parramore | 14/2.4 |
| 4,825,492 | 5/1989 | Zehavi et al. | 14/2.4 |

FOREIGN PATENT DOCUMENTS

| | | | |
|---|---|---|---|
| 075671 | 3/1985 | European Pat. Off. . | |
| 0256446 | 2/1988 | European Pat. Off. | 14/2.4 |
| 259202 | 3/1988 | European Pat. Off. . | |
| 3138853 | 12/1984 | Fed. Rep. of Germany . | |
| 3433178 | 3/1986 | Fed. Rep. of Germany . . | |
| 3628273 | 3/1988 | Fed. Rep. of Germany . | |

*Primary Examiner*—Terry L. Melius

*Attorney, Agent, or Firm*—Spencer & Frank

[57] ABSTRACT

A deployable modular bridge has a central girder; two side girders flanking the central girder; and couplings connecting each side girder to the central girder along the lower zones of the girders parallel to the bridge length. The couplings are arranged symmetrically with respect to a central vertical longitudinal plane of the bridge and permit displacement of the side girders relative to the central girder parallel to the bridge length. Each coupling includes a rail affixed to the central girder and extending parallel to the bridge length. The rail has a guide track formed thereon. Each coupling further includes a roller mounted on a respective side girder and engaging the guide track.

20 Claims, 2 Drawing Sheets

DEPLOYABLE BRIDGE

CROSS REFERENCE TO RELATED APPLICATION

This application claims the priority of Federal Republic of Germany Application No. P 39 14 441.0 filed May 2, 1989, which is incorporated herein by reference.

BACKGROUND OF THE INVENTION

This invention relates to a bridge which is composed of bridge modules and which may be deployed by a launching device. The bridge has two side girders and a central girder which is longitudinally slidably coupled to the side girders and which has approximately the same height as the side girders.

A bridge of the above-outlined type is disclosed, for example, in German Patent No. 3,138,853. The central girder is first extended as an initial carrier, over the obstacle to be spanned and thereafter the bridge modules formed of two side girders and one central part connecting the two side girders—which as viewed together have the shape of an inverted U—are positioned at one bank on the initial carrier (central girder) and pushed thereover onto the opposite bank. For such a displacement, roller-and-rail guides are used which are arranged in the upper zone of the central girder and which connect the central girder with the central part of the bridge modules. Such a coupling is retained in the finished bridge so that the central girder is, by virtue of such a connection, utilized as a load carrier when the bridge is in service.

SUMMARY OF THE INVENTION

It is an object of the invention to provide an improved bridge of the above-outlined type in which the load bearing capability of the central girder is better utilized.

This object and others to become apparent as the specification progresses, are accomplished by the invention, according to which, briefly stated, the deployable modular bridge has a central girder; two side girders flanking the central girder; and couplings connecting each side girder to the central girder along the lower zone of the girders parallel to the bridge length. The couplings are arranged symmetrically with respect to a central vertical longitudinal plane of the bridge and permit displacement of the side girders relative to the central girder parallel to the bridge length. Each coupling includes a rail affixed to the central girder and extending parallel to the bridge length. The rail has a guide track formed thereon. Each coupling further includes a roller mounted on a respective side girder and engaging the guide track.

German Offenlegungsschrift (application published without examination) 3,628,273 discloses a deployable bridge in which a lateral coupling between the two side girders and the central girder (constituting an initial carrier) may be established. In this construction, however, the central girder is significantly lower than the side girders and the coupling is located approximately in the zone of the mid height of the central girder. The same applies to a deployable bridge disclosed in U.S. Pat. No. 4,665,577. Consequently, in the bridge construction according to either of the two last-named references the central carrier participates only to a limited extent in the load carrying function of the bridge.

The invention makes it possible to couple the side girders and the central girder to form a unit which improves to a significant extent not only the moment of inertia of the bridge but also its twist resistance. Such improvements are feasible without the need of additional components and without an increase of the weight of the bridge.

According to a further feature of the invention, the two rails secured to the underside of the central girder function simultaneously as guides for the rollers mounted on the side girders and for the rollers of the bridge-launching device. The rails preferably have at their inner and outer side, respective openings of U-shaped cross section.

According to a preferred embodiment of the invention, no direct connection between the two side girders is present. By virtue of such an arrangement, the central girder may have the same height as the side girders and may at the same time form a central cover for the bridge so that no separate central cover has to be provided.

In accordance with another preferred embodiment of the invention, the side girders are in their upper zone connected to one another by means of one or more connecting elements. This makes the upper roller-and-rail guides unnecessary and thus they may be dispensed with. Nevertheless, it is feasible—in case of a flat, plate-like construction of the connection—to design the central girder of substantially the same height as the side girders and accordingly, its load carrying properties are maintained. Advantageously, this embodiment is so designed that the connection has a plate-like element which is continuous in the longitudinal direction of the bridge. The plate-like element may constitute the sole connection and may serve as the central cover and may lie on top of the central girder. Since such plate-like connection need to transmit only tension forces, it may be of relatively thin construction. The forward shifting of the bridge modules formed of the two side girders and the plate-like connecting element is facilitated by the fact that the plate-like element is supported on rollers mounted on the central girder.

By eliminating an interconnection between the side girders in their upper zone, a simple embodiment according to the invention is obtained by virtue of the fact that the side girders are in each instance connected with the central girder by means of a lower and an upper roller-and-rail guide. In this arrangement advantageously the upper roller-and-rail guide is formed on the central girder by rollers having substantially a vertical rotary axis and rails extending into the rollers and being mounted on the side girders.

According to still another preferred embodiment of the invention, the roller-and-rail guides are so designed and/or arranged that the side girders for connecting them with the central girder may be hooked in from above; this arrangement significantly simplifies the assembly of the bridge modules. Such a simplification applies to all the embodiments of the invention. In case the side girders are not connected to one another, the individual components may be handled with greater ease and have a lesser transport width when placed on transport vehicles. The invention makes it further possible to so design the side girders that they have a downwardly tapering cross section thus saving additional bridge space and transporting space. Such a taper may be formed by an oblique design of the outer cross-sectional edge in which case the loads on the lateral edges of the bridge may be introduced directly by the outer plate-like elements of the side girders into the lower roller-and-rail guides. In this arrangement it is feasible to so arrange the roller axes that perpendicular forces are transmitted to the shaft bearings. Such an arrangement further makes possible a simplified assembly of the bridge modules from above.

DESCRIPTION OF THE PREFERRED EMBODIMENTS

Figure 1:
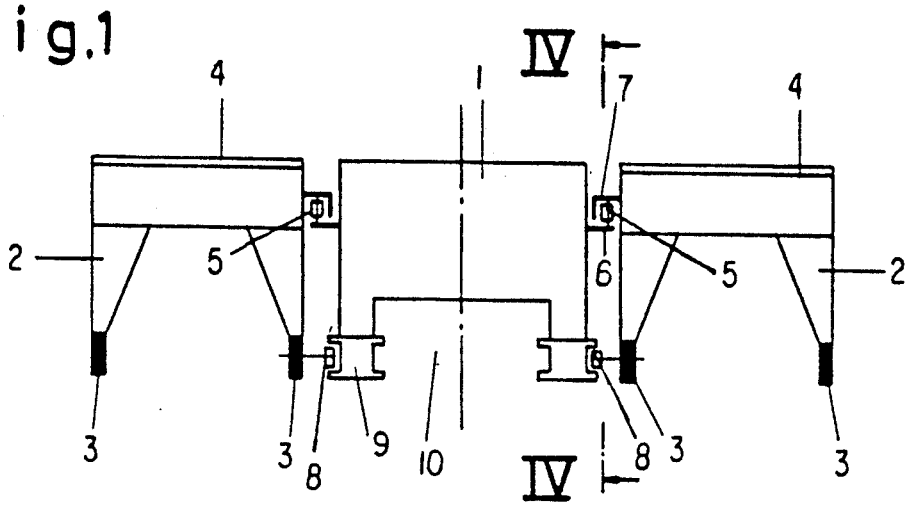
FIGS. 1, 2 and 3 schematic front elevational views of three preferred embodiments of the invention.

Turning to the embodiment illustrated in FIG. 1, there is shown a box-like central girder 1 which has a cross-sectionally rectangular configuration and which is connected with two flanking side girders 2 having, as viewed in cross section, an inverted U shape and each carrying at their lower ends two lower trusses 3. The top side of the side girders 2 is covered with a road plate 4 which is at the same height level as the upper side of the central girder 1. In the upper zone the central girder i carries, on either side, rollers 5 each having vertical rotary shafts supported on a rail 6 attached to the central girder 1. The rollers 5, together with downwardly angled rails 7 which are attached to the respective side girder 2 and which straddle over the respective rollers 5, form therewith a roller-and-rail guide to permit a longitudinal displacement of the side girders 2 relative to the central girder 1. At the respective inner lower trusses 3 of the side girders 2 there are secured rollers 8 having horizontal rotary axes. The rollers 8 extend into laterally open, cross-sectionally U-shaped rails 9 secured to the lower corner regions of the central girder 1. The two couplings which connect each side girder 2 to the central girder 1 and which are each formed of rollers 8 and a rail 9, are situated symmetrically to one another with respect to the central vertical longitudinal plane A of the central girder 1.

Each rail 9 also has at its inwardly oriented side (that is, at the side facing away from the respective adjoining side girder) a U-shaped opening to receive rollers of a non-illustrated bridge-launching device, providing for an initial forward displacement of the central girder 1. For this purpose, the central girder 1 which, as a rule is used as the initial bridge carrier, has a downwardly oriented U-shaped opening 10.

It is feasible to arrange the rollers 8 in a reverse orientation, that is, to mount them for rotation on the rails 9 to engage preferably U-shaped rails secured to the side of the respective inner lower truss 3 of the side girder 2.

The side girders 2 may be advanced, to span the obstacle to be bridged, over the central girder 1 which has already been positioned as an initial bridge carrier. Preferably, the individual modules of the side girders are advanced in pairs synchronously and are coupled with one another. The individual modules of the side girders 2 may be of identical construction and may be therefore interchangeable. In the fully deployed bridge the side girders 2 are connected with the central girder 1 such as to prevent further shifts in the longitudinal direction, whereby a homogeneous construction is obtained as regards load carrying properties.

Figure 2:
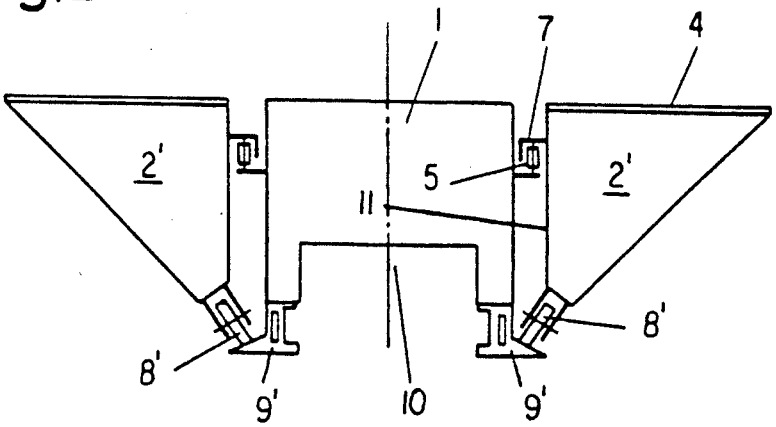

Turning now to the embodiment illustrated in FIG. 2, this construction differs from the bridge shown in FIG. 1 in that the two side girders 2' have a downwardly tapering, generally triangular cross section. The inner plate 11 of the box-like side girders 2' is vertically oriented, that is, it extends parallel to the adjacent external side plate of the central girder 1. At their lower ends the side girders 2' have bilaterally arranged rollers 8' whose rotary axes are oriented obliquely to the horizontal. The inclination is selected such that the pressure forces which are transmitted to the bearing and which are introduced by correspondingly obliquely arranged rails 9' are essentially perpendicular forces. This arrangement further facilitates the insertion of the side girders 2' from above, together with the roller-and-rail guide 5, 6, 7.

Figure 3:
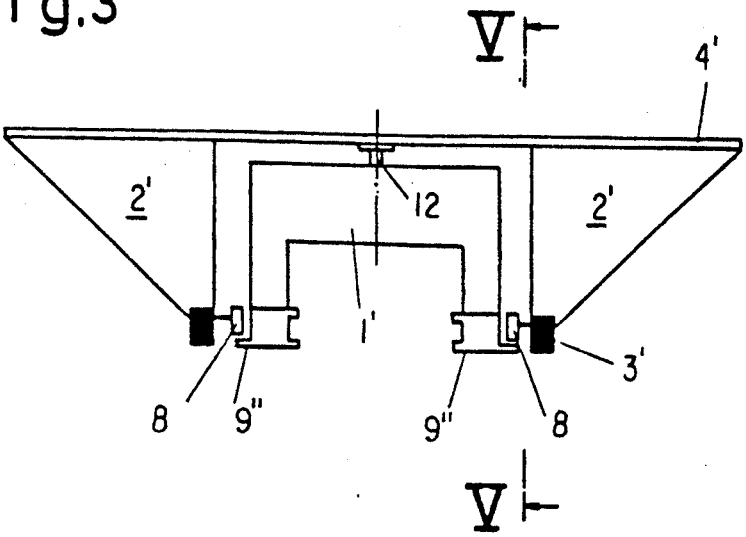

Turning to the preferred embodiment illustrated in FIG. 3, the central girder 1' has a slightly smaller height than the two side girders 2' whose cross sectional configuration is the same as that shown in FIG. 2. The side girders 2' are connected to one another with a road plate 4' which extends over the entire width of the bridge construction. In the vertical central longitudinal plane of the bridge the unit formed of the two side girders 2' is supported by support rollers 12 mounted on the top of the central girder 1' and extending slightly beyond the upper side thereof. A further connection between the side girders 2' and the central girder 1' is formed at the underside of the bridge construction by rollers 8 which, similarly to the arrangement shown in FIG. 1, are supported at a lower truss 3' of each side girder 2'. The guide rails 9'' mounted at the bottom of the central girder 1' have a cross-sectionally L-shaped configuration and project beyond the external sides of the central girder 1' so that the side girder unit (formed of the two side girders 2' and the road plate 4') may be inserted from the top. To obtain the desired load-bearing properties in the finished bridge, there are provided additional, non-illustrated coupling elements for connecting the central girder 1' and the side girders 2' with one another.

The length of the side girders may be identical or, for special applications it may be unequal. It is particularly advantageous to provide interconnectable bridge sections of half lengths. The sections of the central girder also may be of identical or different length as compared to the length of the side girders. All the lengths are coordinated in the first place with the loading dimension of the available transport vehicles.

Figure 4:
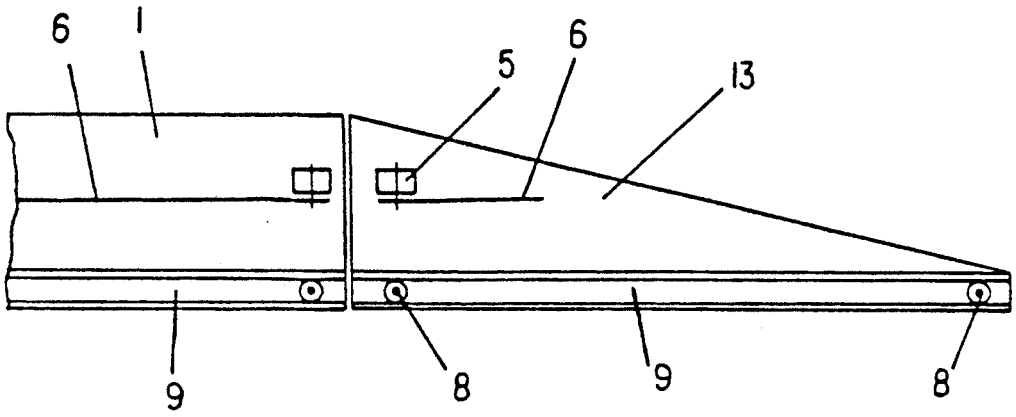
FIG. 4 is a schematic sectional view taken along line IV—IV of FIG. 1.

The terminal ramp length portions of the bridge taper towards the shore and are preferably so designed that the road plates slope downwardly towards the bridge ends. As illustrated in FIG. 4, the central ramp girder 13 has in its lower zone rails 9 which are aligned with the rails 9 of the central girder 1 adjoining the central ramp girder 13. The same applies to the rails 6 arranged bilaterally of the central ramp girder 13 relative to the rails 6 of the central girder 1 adjoining the central ramp girder 13.

Figure 5:
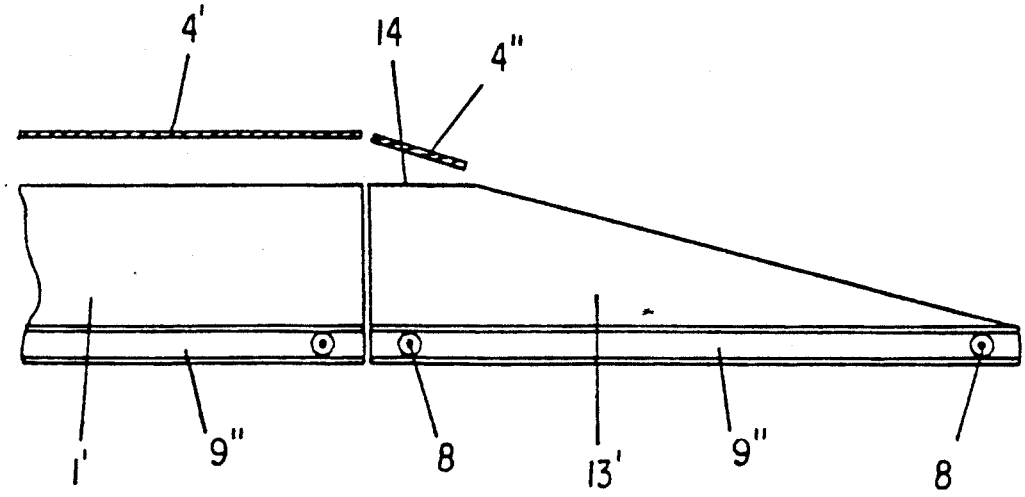
FIG. 5 is a schematic sectional view taken along line V—V of FIG. 3.

Turning to the embodiment shown in FIG. 5, the central ramp girder 13' has on its upper side a horizontal, flattened portion 14 adjoining the central girder 1' and being flush with the upper face thereof. Above the flattened portion 14 there is arranged a road plate portion 4'' which covers the central ramp girder 13' and which also connects the two road plates (not visible in FIG. 5) of the side girders at the same inclination. In case support rollers are provided, the latter, in contrast to the embodiment shown in FIG. 3 (where the road plate portion 4'' is flush with the road plate 4), are arranged at the underside of the road plate 4' or, as the case may be, the road plate portion 4''.

If necessary or expedient, the ramps may be pivotally arranged in a known manner for height adjustment at the adjoining bridge section.

It will be understood that the above description of the present invention is susceptible to various modifications, changes and adaptations, and the same are intended to be comprehended within the meaning and range of equivalents of the appended claims.

What is claimed is:

1. A deployable modular bridge having a length, comprising (a) a central girder having a lower zone, the lower zone of the central girder having a downwardly open U-shaped when viewed in cross section;

(b) two side girders flanking said central girder each having a lower zone; and (c) couplings connecting each said side girder to said central girder along said lower zones parallel to said length; said couplings being arranged symmetrically with respect to a central vertical longitudinal plane of the central girder and permitting displacement of the side girders relative to the central girder parallel to said length; each said coupling including (1) a rail affixed to said central girder and extending parallel to said length; said rail having first and second parallel guide tracks formed thereon; said rail having, when viewed in cross section, back-to-back arranged, laterally open first and second U-shaped openings forming part of said first and second guide tracks, respectively; and (2) a roller mounted on a respective said side girder and engaging said first guide track.

2. A deployable modular bridge as defined in claim 1, wherein said central and side girders have approximately identical heights.

3. A deployable modular bridge as defined in claim 1, wherein said side girders have respective upper zones; further comprising connecting means connecting said side girders to one another in said upper zones.

4. A deployable modular bridge as defined in claim 3, wherein said connecting means comprises a plate-shaped element extending throughout said length.

5. A deployable modular bridge as defined in claim 4, wherein said plate-shaped element extends above a top side of said central girder; further comprising a support roller mounted on the central girder and being situated between said top side and said plate-shaped element 6. A deployable modular bridge as defined in claim 1, wherein said couplings are lower couplings; further comprising upper couplings each comprising a roller-and-rail guide; said upper couplings being arranged in respective upper zones of said central and side girders and connecting each said side girder to said central girder; said upper couplings permitting displacement of the side girders relative to said central girder parallel to said length.

7. A deployable modular bridge as defined in claim 6, wherein each said upper coupling comprises a roller mounted on said central girder for rotation about a vertical axis and a rail mounted on each side girder and straddling the roller of said upper coupling.

8. A deployable modular bridge as defined in claim 1, wherein each said side girder has a downwardly tapering cross section as viewed in a plane perpendicular to said length.

9. A deployable modular bridge as defined in claim 8, wherein each said side girder has a side remote from said central girder; said side is inclined downwardly towards said central girder.

10. A deployable modular bridge having a length, comprising a central girder having a pair of spaced-apart, downwardly-descending leg portions;

two side girders flanking said central girder each having a lower zone; and couplings connecting each said side girder to said central girder parallel to said length; said couplings being arranged symmetrically with respect to a central vertical longitudinal plane of the bridge and permitting displacement of the side girders relative to the central girder parallel to said length; each said coupling including a first coupling component mounted on a respective leg portion of said central girder and second coupling component mounted on the lower zone of a respective side girder; one of the first and second coupling components including a rail extending parallel to said length and having a guide track formed thereon; and the other of said first and second coupling components including a roller engaging said guide track, wherein each of said first coupling components additionally was an inner side with an elongated U-shaped opening, said U-shaped openings of said first coupling components extending parallel to said length and being directed toward one another.

11. A deployable modular bridge as defined in claim 10, wherein said central and side girders have approximately identical heights.

12. A deployable modular bridge as defined in claim 10, wherein said side girders have respective upper zones; further comprising connecting means connecting said side girders to one another in said upper zones.

13. A deployable modular bridge as defined in claim 12, wherein said connecting means comprises a plate-shaped element extending through said length.

14. A deployable modular bridge as defined in claim 13, wherein said plate-shaped element extends above a top side of said central girder; further comprising a support roller mounted on the central girder and being situated between said top side and said plate-shaped element.

15. A deployable modular bridge as defined in claim 10, wherein said couplings are lower couplings; further comprising upper couplings each comprising a roller-and-rail guide; said upper couplings being arranged in respective upper zones of said central and side girders and connecting each said side girder to said central girder; said upper couplings permitting displacement of the side girders relative to said central girder parallel to said length.

16. A deployable modular bridge as defined in claim 15, wherein each said upper coupling comprises a roller mounted on said central girder for rotation about a vertical axis and a rail mounted on each side girder and straddling the roller of said upper coupling.

17. A deployable modular bridge as defined in claim 10, wherein the rails and rollers of said couplings are so configured that said rollers are unimpededly liftable off or lowerable onto the rails, whereby the side tracks girders are connectable with the central girder by lowering the side girders to a level of said central girder.

18. A deployable modular bridge as defined in claim 10, wherein each said side girder has a downwardly tapering cross section as viewed in a plane perpendicular to said length.

19. A deployable modular bridge having a length, comprising (a) a central girder having a top side and having a lower zone;

(b) two side girders flanking said central girder each having a lower zone and an upper zone;

(c) couplings connecting each said side girder to said central girder along said lower zones parallel to said length; said couplings being arranged symmetrically with respect to a central vertical longitudinal plane of the central girder and permitting displacement of the side girders relative to the central girder parallel to said length; each said coupling including (1) a rail affixed to said central girder and extending parallel to said length; said rail having a guide track formed thereon; and (2) a roller mounted on a respective said side girder and engaging said guide track;

(d) connecting means connecting said side girders to one another in said upper zones, said connecting means including a plate-shaped element extending throughout said length; said plate-shaped element extending above said top side of said central girder; and (e) a support roller mounted on said central girder, said support roller being situated between said top side of said central girder and said plate-shaped element.

20. A deployable modular bridge having a length, comprising (a) a central girder having a lower zone;

(b) two side girders flanking said central girder each having a lower zone; and (c) couplings connecting each said side girder to said central girder along said lower zones parallel to said length; said couplings being arranged symmetrically with respect to a central vertical longitudinal plane of the central girder and permitting displacement of the side girders relative to the central girder parallel to said length; each said coupling including (1) a rail affixed to said central girder and extending parallel to said length; said rail having a guide track formed thereon; and (2) a roller mounted on a respective said side girder and engaging said guide track, wherein the rails and rollers of said couplings are so configured that said rollers are unimpededly liftable off or lowerable onto the rails, whereby the side girders are connectable with the central girder by lowering the side girders to a level of said central girder.

* * * * *